US008498561B2

(12) United States Patent
Yamaguchi et al.

(10) Patent No.: US 8,498,561 B2
(45) Date of Patent: Jul. 30, 2013

(54) FIXING DEVICE AND IMAGE FORMING APPARATUS INCORPORATING SAME HAVING A REINFORCING MEMBER INCLUDING FIRST AND SECOND FLANGES

(75) Inventors: Yoshiki Yamaguchi, Sagamihara (JP); Masaaki Yoshikawa, Tokyo (JP); Kenji Ishii, Kawasaki (JP); Hiroshi Yoshinaga, Ichikawa (JP); Naoki Iwaya, Chofu (JP); Tetsuo Tokuda, Kawasaki (JP); Yutaka Ikebuchi, Chigasaki (JP); Takahiro Imada, Yokohama (JP); Takamasa Hase, Kawasaki (JP); Toshihiko Shimokawa, Zama (JP); Kenichi Hasegawa, Atsugi (JP); Akira Shinshi, Machida (JP); Ippei Fujimoto, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 12/946,276

(22) Filed: Nov. 15, 2010

(65) Prior Publication Data

US 2011/0116848 A1 May 19, 2011

(30) Foreign Application Priority Data

Nov. 17, 2009 (JP) ..... 2009-261603

(51) Int. Cl.
*G03G 15/20* (2006.01)
*G03G 15/16* (2006.01)

(52) U.S. Cl.
USPC ..... 399/329; 399/122

(58) Field of Classification Search
USPC ..... 399/122, 328, 329
See application file for complete search history.

(56) References Cited

U.S. PATENT DOCUMENTS 7,702,271 B2 4/2010 Yamada et al.
2005/0036809 A1 2/2005 Fukita et al.

(Continued)

FOREIGN PATENT DOCUMENTS

CN 1577167 A 2/2005
CN 101403884 A 4/2009

(Continued)

OTHER PUBLICATIONS

Extended Search Report issued May 27, 2011 in Europe Application No. 10190671.7.

(Continued)

*Primary Examiner* — Joseph S Wong
(74) *Attorney, Agent, or Firm* — Oblon, Spivak, McClelland, Maier & Neustadt, L.L.P.

(57) ABSTRACT

A fixing device includes an endless belt, a fuser pad, a pressure member, a tubular belt holder, and a reinforcing member. The endless belt is looped into a generally cylindrical configuration extending in an axial direction. The fuser pad extends in the axial direction inside the loop of endless belt. The pressure member extends in the axial direction with the belt interposed between the fuser pad and the pressure member. The pressure member is pressed against the fuser pad through the fuser belt to form a fixing nip. The belt holder extends in the axial direction inside the loop of endless belt to retain the belt in shape along an outer circumference thereof. The belt holder accommodates the fuser pad in a longitudinal side slot defined on one side thereof. The reinforcing member is disposed inside the tubular belt holder to reinforce the belt holder around the side slot.

13 Claims, 10 Drawing Sheets

U.S. PATENT DOCUMENTS

| | | | | |
|---|---|---|---|---|
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2008/0305426 | A1 * | 12/2008 | Kurimoto et al. | 430/125.5 |
| 2009/0092423 | A1 | 4/2009 | Shin et al. | |
| 2009/0110451 | A1 | 4/2009 | Jung et al. | |
| 2009/0148204 | A1 | 6/2009 | Yoshinaga et al. | |
| 2009/0148205 | A1 | 6/2009 | Seo et al. | |
| 2009/0162116 | A1 | 6/2009 | Mogi et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2009/0311016 | A1 | 12/2009 | Shinshi | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2011/0091254 | A1 | 4/2011 | Shin et al. | |

FOREIGN PATENT DOCUMENTS

| | | | |
|---|---|---|---|
| EP | 1 496 406 | A1 | 1/2005 |
| EP | 2 045 671 | A1 | 4/2009 |
| EP | 2 053 472 | A1 | 4/2009 |
| JP | 10-213984 | | 8/1998 |
| JP | 2884714 | | 2/1999 |
| JP | 3298354 | | 4/2002 |
| JP | 2007-183321 | A | 7/2007 |
| JP | 2007-334205 | | 12/2007 |
| JP | 2009-3410 | | 1/2009 |

OTHER PUBLICATIONS

Office Action issued Jul. 30, 2012, in Chinese Patent Application No. 201010545697.2.

* cited by examiner

FIXING DEVICE AND IMAGE FORMING APPARATUS INCORPORATING SAME HAVING A REINFORCING MEMBER INCLUDING FIRST AND SECOND FLANGES

CROSS-REFERENCE TO RELATED APPLICATIONS

The present patent application claims priority pursuant to 35 U.S.C. §119 from Japanese Patent Application No. 2009-261603, filed on Nov. 17, 2009, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatus, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally or at least partially cylindrical looped belts or rollers, one being heated for fusing toner ("fuser member") and the other being pressed against the heated one ("pressure member"), which together form a heated area of contact called a fixing nip through which a recording medium is passed to fix a toner image under heat and pressure.

FIG. 1 is an end-on, axial cutaway view schematically illustrating a conventional fixing device 200, which employs a pair of generally cylindrical fixing members, one being a heated fuser belt 204 and the other being a pressure roller 205 pressed against the fuser belt 204.

As shown in FIG. 1, in the fixing device 200, the fuser belt 204 is looped into a partially cylindrical configuration along an outer surface of a cylindrical fuser roller 203 which is formed of an elastic material such as rubber. The fuser belt 204 is rotatable around the fuser roller 203 as well as a heat roller 202 internally equipped with a heater 201 that heats the length of the belt 204 upon contacting the heat roller 202. The pressure roller 205 is pressed against the fuser roller 203 via the fuser belt 204 to form a fixing nip N therebetween.

During operation, a recording medium S bearing an unfixed, toner image thereon enters the fixing nip N. As the pressure roller 205 rotates, the incoming sheet S advances together with the fuser belt 213 along the surface of the fuser roller 203, so as to fix the toner image in place with heat from the fuser belt 204 and pressure from the pressure roller 205.

FIG. 2 is an end-on, axial cutaway view schematically illustrating another conventional fixing device 210, which employs a fuser belt 213 formed of thin heat-resistant film rotatably held around a stationary, ceramic heater 211, in place of the fuser belt 204 entrained around the rotatable rollers 202 and 203.

As shown in FIG. 2, the fixing device 210 has a pressure roller 212 that rotates in pressure contact with the stationary heater 211 through the rotatable fuser film 213 to form a fixing nip N therebetween. As in the case with the fixing device 200, upon entry of a recording sheet into the fixing nip N, the pressure roller 212 rotates to advance the incoming sheet together with the fuser film 213 along the surface of the stationary heater 211, so as to fix the toner image in place with heat from the heater 211 through the fuser film 213 and pressure from the pressure roller 212.

The configuration based on the combination of the heat-resistant film 213 and the stationary heater 211 is commonly employed in a high-speed, on-demand printer, which can promptly execute a print job upon startup without significant energy consumption. The use of the heat-resistant film 213, which exhibits a relatively low heat capacity, and therefore can be swiftly heated, eliminates the need for preparing and keeping the heater 211 in a sufficiently heated state for immediate processing of an incoming print job, resulting in shorter periods of wait time required to execute an initial print job upon startup, as well as smaller amounts of energy wasted during standby time.

Although generally successful for its intended purpose, the conventional fixing device 210 has several drawbacks. One drawback is its vulnerability to wear, where the heat-resistant film 213 has its inner surface repeatedly brought into frictional contact with the surface of the stationary ceramic heater 211. The frictionally contacting surfaces of the film 213 and the heater 211 readily chafe and abrade each other, which, after a long period of operation, results in increased frictional resistance at the heater/film interface, leading to disturbed rotation of the fuser belt 213, or increased torque required to drive the pressure roller 212. If not corrected, such defects can eventually cause failures, such as displacement of a printed image caused by a recording sheet slipping through the fixing nip, and damage to a gear train driving the fixing members due to increased stress during rotation.

Another drawback of the fixing device 210 is the difficulty in maintaining a uniform processing temperature throughout the fixing nip N. The problem arises where the fuser film 213, which is once locally heated at the fixing nip N by the heater 211, gradually loses heat as it travels downstream the fixing nip N, so as to cause a large discrepancy in temperature between immediately downstream from the fixing nip N (where the fuser belt is hottest) and immediately upstream from the fixing nip N (where the fuser belt is coldest). Such thermal instability adversely affects fusing performance of the fixing device 210, particularly in a high-speed application where the rotational fixing member tends to dissipate higher amounts of heat during rotation at a high processing speed.

The former drawback of the fixing device 210 has been addressed by another, improved conventional fixing device, which uses a lubricant, such as a low-friction sheet of fiberglass impregnated with polytetrafluoroethylene (PTFE), disposed between the contacting surfaces of a stationary pressure pad and a rotatable fixing belt. In this improved fixing device, the rotatable fixing belt is looped for rotation around the stationary pressure pad, while held in contact with an internally heated, rotatable fuser roller that has an elastically deformable outer surface. The pressure pad is spring-loaded to press against the fuser roller through the fixing belt, which establishes a relatively large fixing nip therebetween as the fuser roller elastically deforms under pressure.

According to this arrangement, the provision of the lubricant sheet prevents abrasion and chafing at the interface of the stationary and rotatable fixing members, as well as concomitant defects and failures of the fixing device. Moreover, the relatively large fixing nip translates into increased efficiency in heating a recording sheet by conduction from the fuser roller, which allows for designing a compact fixing device with reduced energy consumption.

However, the improved conventional method does not address the thermal instability caused by locally heating the fixing belt at the fixing nip, as is the case with the conventional fixing device 210. Further, both conventional methods share a common problem due to the use of a fixing roller that exhibits a relatively high heat capacity and therefore takes time to heat up to a desired processing temperature, leading to increased periods of time required during warm-up. Hence, although designed to provide an increased thermal efficiency through use of a heat-resistant fuser film or an elastically deformable fuser roller, the conventional methods fail to provide satisfactory fixing performance for high-speed, on-demand applications.

To cope with the problems of the conventional fixing devices, a further improved method has been proposed, which employs a generally cylindrical, stationary tubular belt holder of thermally conductive material that can heat the entire length of a fuser belt held around its circumference and subjected to heating, instead of a stationary heater or heated roller that locally heats the fuser belt or film solely at the fixing nip. FIG. 3 is an end-on, axial cutaway view schematically illustrating a fixing device 220 employing a thermal belt holder 224.

As shown in FIG. 3, the fixing device 220 includes a fuser belt 221 looped into a generally cylindrical configuration, and a generally cylindrical pressure roller 222, both extending in an axial, longitudinal direction in which FIG. 3 is drawn. Disposed inside the loop of fuser belt 221 is a stationary, generally rigid fuser pad 223 against which the pressure roller 222 is pressed through the fuser belt 221 to form a fixing nip N therebetween.

The tubular belt holder 224 extends in the axial direction inside the loop of fuser belt 221, defining a longitudinal side slot 224*a* on one side thereof to accommodate the fuser pad 223 with a thermal insulator 225 disposed between the adjoining walls of the belt holder 224 and the fuser pad 223. The belt holder 224 is equipped with a reinforcing member 226 and a radiant heater 227 both extending in the axial direction inside the tubular belt holder.

During operation, the pressure roller 222 rotates clockwise in the drawing in contact with the fuser belt 221, which in turn rotates counterclockwise in the drawing around the stationary belt holder 224. The rotating belt 221 is guided by the circumference of the belt holder 224, which is internally heated with the radiant heater 227 to radially heat the fuser belt 221 during rotation.

In the fixing device 220, the thermal belt holder 224 is formed by bending a thin sheet of metal into a tubular configuration. The thin-walled belt holder 224 can swiftly conduct heat to the fuser belt 221, while guiding substantially the entire length of the belt 221 along the outer circumference thereof. Using the thin-walled conductive belt holder 224 thus allows for heating the fuser belt 221 swiftly and uniformly, resulting in shorter periods of warm-up time which meet high-speed, on-demand applications.

One difficulty encountered when using a thin-walled thermal belt holder is that the thin-walled tubular member is vulnerable to bending when subjected to high pressure applied perpendicular to the axial direction. Such deformation or displacement of the belt holder would result in inconsistencies in the width or strength of the fixing nip, adversely affecting the performance of the fixing device. To address this difficulty, the fixing device 220 employs the fuser pad 223 and the reinforcing member 226 to retain the belt holder 224 in shape and position to maintain a proper width and strength of the fixing nip N.

Specifically, the fixing device 220 forms the fixing nip N by pressing the pressure roller 222 against the fuser pad 223, which isolates the belt holder 221 from pressure at the fixing nip N. Formed of a rigid material, the fuser pad 223 is held stationary in both axial and transaxial directions to resist pressure from the pressure roller 222, thereby obtaining a desired width and strength of the fixing nip N. Using the stationary fuser pad 223 allows for use of an extremely thin-walled belt holder to maximize thermal efficiency in heating the fuser belt, leading to reduced warm-up time and reduced energy consumption of the fixing device.

In addition to the fuser pad 223 isolating the heat pipe from nip pressure, the fixing device 220 has the reinforcing member 226 to reinforce the belt holder 224 around the fixing nip N. The reinforcing member 226 comprises a T-beam having an axial cross-section in the shape of letter "T" with a flange (i.e., the vertical leg of the T) extending in a load direction in which the pressure roller 222 exerts nip pressure, held against the inner circumference of the belt holder 224 forming the wall of the side slot 224*a*.

Although provided to resist pressure transmitted from the pressure roller 222 through the fuser pad 223, the T-beam reinforcement 226 often fails to withstand nip pressure, with its flange bending or deformed in the axial direction. Such deformation of the reinforcing member 226 translates into displacement or deformation of its surrounding structure, in particular, that of the fuser pad 223, resulting in variations in width and strength of the fixing nip N.

To provide the reinforcing member 226 with sufficient strength, a common approach is to form the T-beam with increased length, depth, and thickness. Unfortunately, such an approach is impractical as the reinforcing member 226 is required to be accommodated within a limited space inside the belt holder 224, which imposes limitations on the dimensions of the T-beam reinforcement 226. Moreover, positioning the larger reinforcing member 226 within the heat pipe can reduce efficiency in heating the fuser belt 221 with the belt holder 224, where the enlarged dimensions of the T-beam 226 prevent radiation from reaching the circumference of the belt holder 224, or where the larger thickness of the T-beam 226, exhibiting an increased heat capacity, tends to absorb a greater amount of heat.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes an endless belt, a fuser pad, a pressure member, a generally cylindrical, tubular belt holder, and a reinforcing member. The endless belt is looped into a generally cylindrical configuration extending in an axial direction. The fuser pad extends in the axial direction inside the loop of endless belt. The pressure member extends in the axial direction with the belt interposed between the fuser pad and the pressure member. The pressure member is pressed against the fuser pad through the fuser belt to form a fixing nip through which a recording medium travels from upstream to downstream in a tangential direction substantially perpendicular to the axial direction. The belt holder extends in the axial direction inside the loop of endless belt to retain the belt in shape along an outer circumference thereof. The belt holder accommodates the fuser pad in a longitudinal side slot defined on one side thereof by a pair of opposed first and second walls extending inward from the holder circumference, the former being upstream and the latter downstream of the fixing nip in the tangential direction. The reinforcing member is disposed inside the belt holder to reinforce the belt holder around the side slot. The reinforcing member includes a first flange and a second flange. The first flange extends along the first wall inside the belt holder. The second flange extends along the second wall inside the belt holder.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

BRIEF DESCRIPTION OF THE DRAWINGS

Amore complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
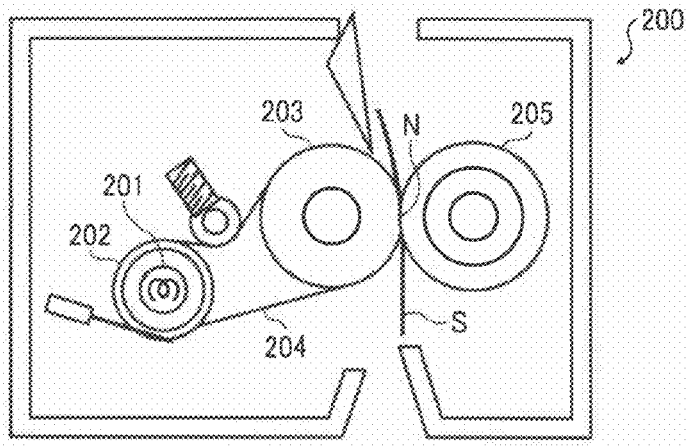
FIG. 1 BACKGROUND ART
FIG. 1 is an end-on, axial cutaway view schematically illustrating a conventional fixing device.
Figure 2:
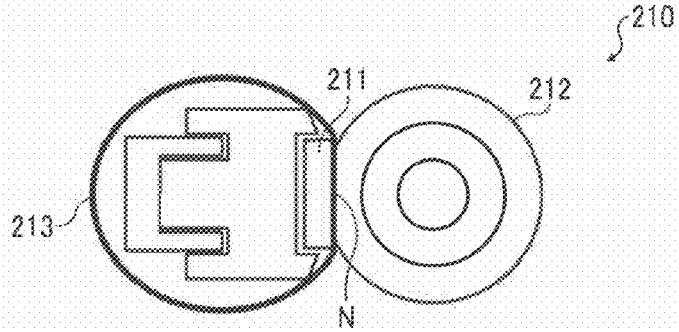
FIG. 2 BACKGROUND ART
FIG. 2 is an end-on, axial cutaway view schematically illustrating another conventional fixing device.
Figure 3:
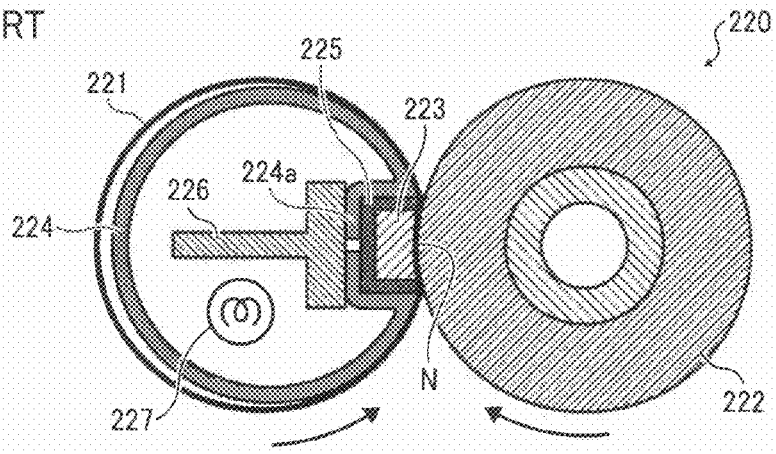
FIG. 3 BACKGROUND ART
FIG. 3 is an end-on, axial cutaway view schematically illustrating a still another conventional fixing device.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 4:
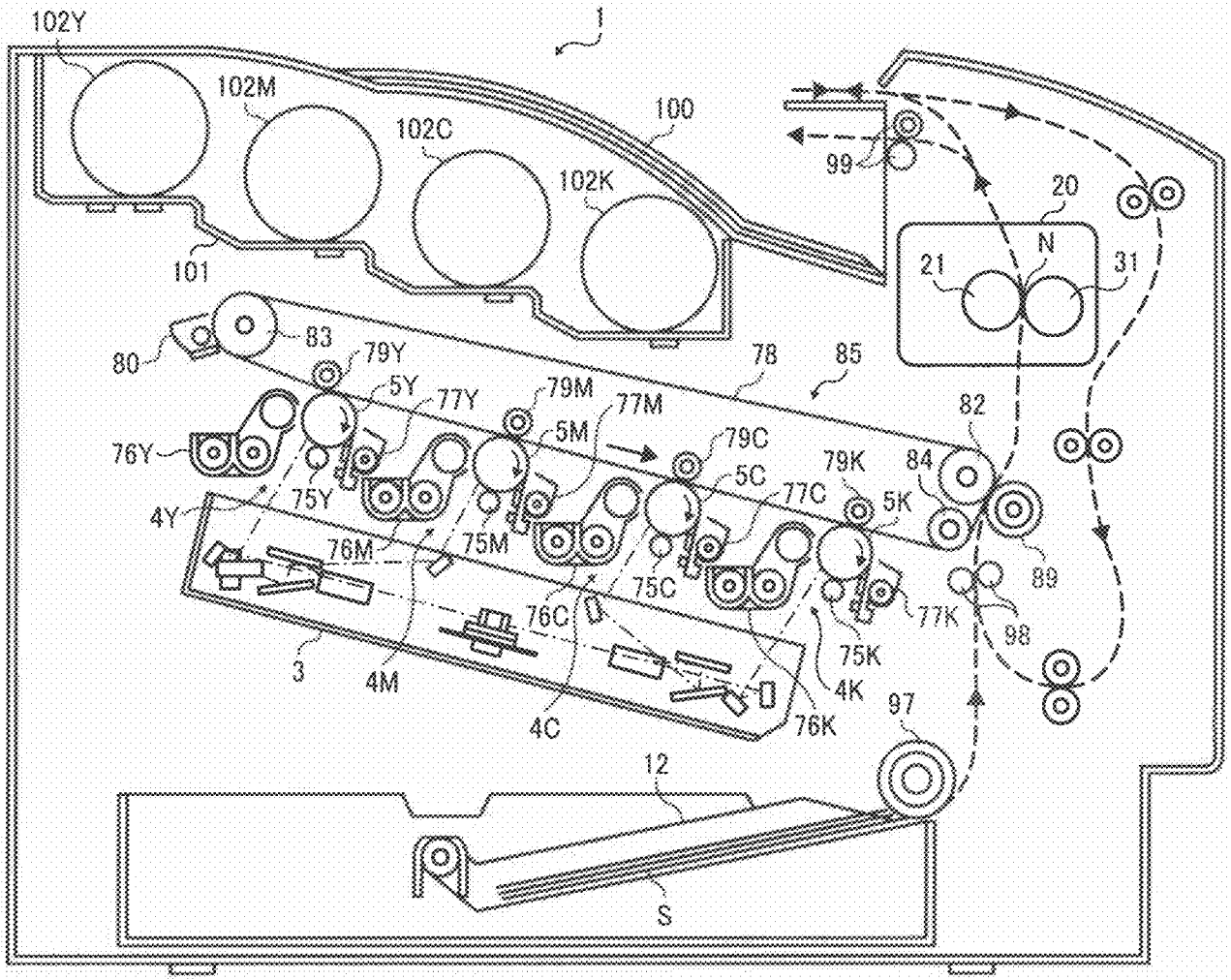
FIG. 4 schematically illustrates an image forming apparatus incorporating a fixing device according to one embodiment of this patent specification.

FIG. 4 schematically illustrates an image forming apparatus 1 incorporating a fixing device 20 according to one embodiment of this patent specification.

As shown in FIG. 4, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 5 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of the toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 5:
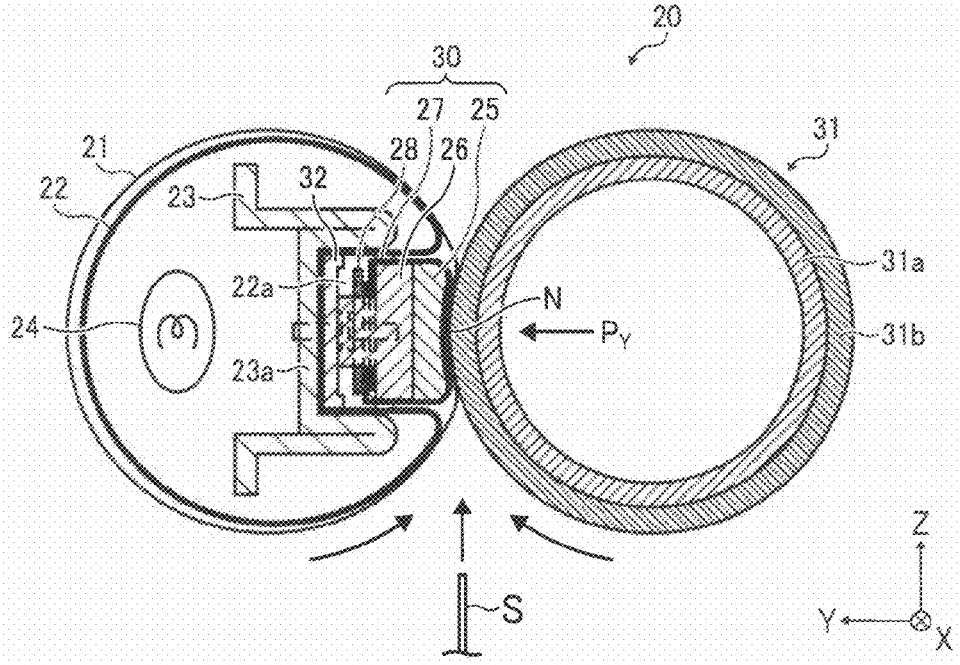
FIG. 5 is an end-on, axial cutaway view schematically illustrating the fixing device included in the image forming apparatus of FIG. 4.

FIG. 5 is an end-on, axial cutaway view schematically illustrating the fixing device 20 incorporated in the image forming apparatus 1 according to this patent specification.

As shown in FIG. 5, the fixing device 20 includes a rotatable fuser belt 21 looped into a generally cylindrical configuration for rotation, and a rotatable, generally cylindrical pressure roller 31 held in pressure contact with an outer surface of the fuser belt 21. The cylindrical loop of fuser belt 21 and the pressure roller 31 are disposed parallel to each other along an axial, longitudinal direction X in which FIG. is drawn.

Inside the loop of the fuser belt 21 is a thermally conductive, generally cylindrical tubular belt holder 22 extending in the axial direction X, which retains the belt 21 in shape, while imparting heat to the belt 21 along its outer circumference. A heater 24 is disposed inside the tubular belt holder 22 to irradiate the belt holder 22 to heat the belt 21 therearound.

The belt holder 22 has its circumference partially bent inward to define an elongated slot 22*a* on one side thereof facing the pressure roller 31, within which is disposed a fuser pad assembly 30 extending in the axial direction X, formed of a fuser pad 25, a pad base 26, a lubricant sheet 27, a support plate 28, etc., combined together into a unitary assembly. The belt holder 22 is equipped with a retaining stay 32 fitting within the side slot 22*a* along the outer surface thereof, and a reinforcing member 23 fitting around the side slot 22*a* along the inner surface thereof.

The pressure roller 31 is pressed with force $P_Y$ in a load direction Y substantially perpendicular to the axial direction X against the fuser pad assembly 30 through the fuser belt 21 by a biasing mechanism, not shown. The pressure roller 31 and the fuser belt 21 thus define a fixing nip N therebetween, extending in a tangential, sheet conveyance direction Z substantially perpendicular to the axial direction X and the load direction Y. Under pressure $P_Y$ exerted from the pressure roller 31, the fuser pad assembly 30 is held in position against the reinforcing member 23 through the walls of the retaining stay 32 and the belt holder 22.

Components of the fixing device 20 related to properties of the fixing nip N, such as the fuser belt 21, the belt holder 22, the reinforcing member 23, the heater assembly 24, the pressure roller 31, and the fuser pad assembly 30 formed of the pad 25, the pad base 26, the lubricant sheet 27, and the support plate 28, all extend in the axial, longitudinal direction X, and several of which (including at least the belt 21, the holder 22, and the member 23) have their longitudinal ends held on a chassis, not shown, of the fixing device 20 either directly or indirectly. In particular, although not depicted in FIG. 5, the reinforcing member 23 has a pair of longitudinal ends each provided with a mounting flange 35 for mounting to the chassis, as will be described later in more detail.

During operation, the fixing device 20 activates the heater 24 and the pressure roller 31 as the image forming apparatus 1 is powered up. Upon activation, the pressure roller 31 starts rotation clockwise in FIG. 5 in frictional contact with the fuser belt 21, which in turn rotates around the belt holder 22 counterclockwise in FIG. 5.

At the same time, a recording sheet S, which has been fed from the sheet tray 12 to pass through the secondary transfer nip to form an unfixed, powder toner image thereon, enters the fixing device 20. Upon reaching the fixing nip N, the recording sheet S moves along the rotating surfaces of the belt 21 and the roller 31 in the sheet conveyance direction Z, substantially flat and erect along surfaces of guide plates, not shown, disposed along the sheet conveyance path.

At the fixing nip N, the fuser belt 21 heats the incoming sheet S to fuse and melt the toner particles, while the pressure roller 31 presses the sheet S against the fuser pad 26 in the load direction Y to cause the molten toner to settle onto the sheet surface. As the toner image is thus fixed in place through the fixing nip N, the recording sheet S is forwarded to exit the fixing device 20 for entering the discharge unit.

The configuration based on the fuser belt 21 disposed around the thermally conducive belt holder 22 is mechanically stable and relatively inexpensive to manufacture, while providing quick startup and stable fixing performance for an extended period of time as the belt holder 22 rapidly distributes heat to uniformly heat the entire length of the fuser belt 21 to a consistent processing temperature upon warm-up.

According to this patent specification, the reinforcing member 23 serves to reinforce the belt holder 22 by adding mechanical strength to those portions of the belt holder 22 forming the side slot 22*a*. The reinforcing member 23, held stable and stationary in position in the axial direction X, reliably positions the fuser pad assembly 30 and the fuser belt 21 pressed in the load direction Y against the reinforcing member 23, so as to maintain uniform width and strength of the fixing nip N being established. A detailed description of the reinforcing member 23 and its surrounding structure will be given with FIG. 6 and subsequent drawings.

In the present embodiment of the fixing device 20, the fuser belt 21 comprises a thin, multi-layered, looped flexible belt approximately 1 mm or less in thickness, the overall length of which is formed of a substrate covered with an intermediate elastic layer and an outer release coating deposited on an outer surface of the substrate, one atop another, and optionally, an inner lubricant coating deposited on an inner surface of the substrate.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfide (PES), or the like, approximately 10 to 50 μm in thickness. The inner lubricant coating may be a deposit of a lubricating agent such as fluorine resin.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. The release coating layer provides good stripping of toner from the belt surface to ensure reliable conveyance of recording sheets S through the fixing nip N. The lubricant coating layer promotes smooth sliding along the circumference of the belt holder 22.

A specific example of the fuser belt includes an endless belt with an inner diameter approximately 30 mm and an outer diameter approximately 30.52 mm in its generally cylindrical looped shape, formed of a nickel substrate approximately 30 μm thick, an intermediate elastic layer of silicone rubber approximately 200 μm thick, and an outer release coating of PFA approximately 30 μm thick.

The belt holder 22 comprises a tubular pipe formed of a thermally conductive material, such as aluminum, iron, stainless steel or other suitable metal. Although the embodiment depicted in FIG. 5 uses a tube of generally circular cross-section, the belt holder 22 may be formed in various configurations, including cylinders, prisms, and composite shapes, with a cross-section defined by straight lines, curves, or a combination of both.

In the present embodiment, the belt holder 22 is a stainless steel pipe approximately 0.1 mm in wall thickness, approximately 29.3 mm in inner diameter, and approximately 29.5 mm in outer diameter, with its tubular body internally coated with heat-resistant, black absorptive material to effectively absorb radiation from the heaters 25.

The belt holder 22 has its outer surface facing or closely adjacent to the inner surface of the fuser belt 21, along which the rotating belt 21 is guided to retain its generally cylindrical configuration except at the fixing nip N where the belt 21 is pressed against the fuser pad assembly 30 by the pressure roller 31. A lubricating agent, such as silicone oil or fluorine grease, may be provided at the interface between the fuser belt 21 and the belt holder 22 to promote sliding of the belt inner surface along the pipe outer surface.

The heater 24 comprises one or more elongated radiant heating elements, such as halogen heaters or carbon heaters, extending in the axial direction X. Although the embodiment depicted in FIG. 5 uses a single elongated heating element, the heater 24 may be configured with a pair of heating elements, one dedicated to heating A4-size copy sheets and the other dedicated to heating A3-size copy sheets, or any number of heating elements depending on the specific application of the fixing device 20.

The radiant heater 24 heats the belt holder 22 by radiation, which in turn heats the length of fuser belt 21 rotating around the belt holder 22. Instead of heating the fuser belt 21 through radiation, any heating mechanism may be used to heat the fuser belt 21, such as resistance heater or induction heater coil disposed on the heat pipe, or forming the fuser belt 21 with a heating element.

The pressure roller 31 comprises a hollow cylindrical rotatable body formed of a tubular core 31*a* of metal covered with an elastic layer 31*b* of rubber, such as solid or sponge silicone rubber, and an outer coating of release agent, such as PFA or PTFE, deposited one atop another.

A specific embodiment of the pressure roller 31 includes a hollow cylindrical body approximately 30.26 mm in outer diameter, formed of a tubular core of iron approximately 1 mm thick and approximately 24 mm in outer diameter covered with an elastic layer of silicone rubber approximately 3.1 mm thick and an outer layer of PFA approximately 30 μm thick.

The pressure roller 31 is connected to a drive motor, not shown, via a gear train that imparts a rotational force to drive the roller 31. The pressure roller 31 is spring-loaded or otherwise biased against the fuser pad assembly 30 with the force $P_Y$, which compresses the elastic fuser pad 25 to yield a desired width or length of the fixing nip N along the circumference of the pressure roller 31.

Although the embodiment depicted in FIG. 5 uses a hollow cylindrical roller, instead, the pressure roller 31 may be configured either as a hollow cylinder or as a solid cylindrical body, the former being advantaged over the latter due to its relatively small heat capacity. With a hollow configuration, the pressure roller 31 may have a heat source, such as a halogen heater, disposed within its hollow interior.

Where the pressure roller 31 has no dedicated heat source, the pressure roller 31 preferably has its elastic layer formed of sponge rubber, which, compared to solid rubber, insulates heat effectively and therefore can reduce the amount of heat lost from the fuser belt 21 upon contacting the pressure roller 31.

Figure 6:
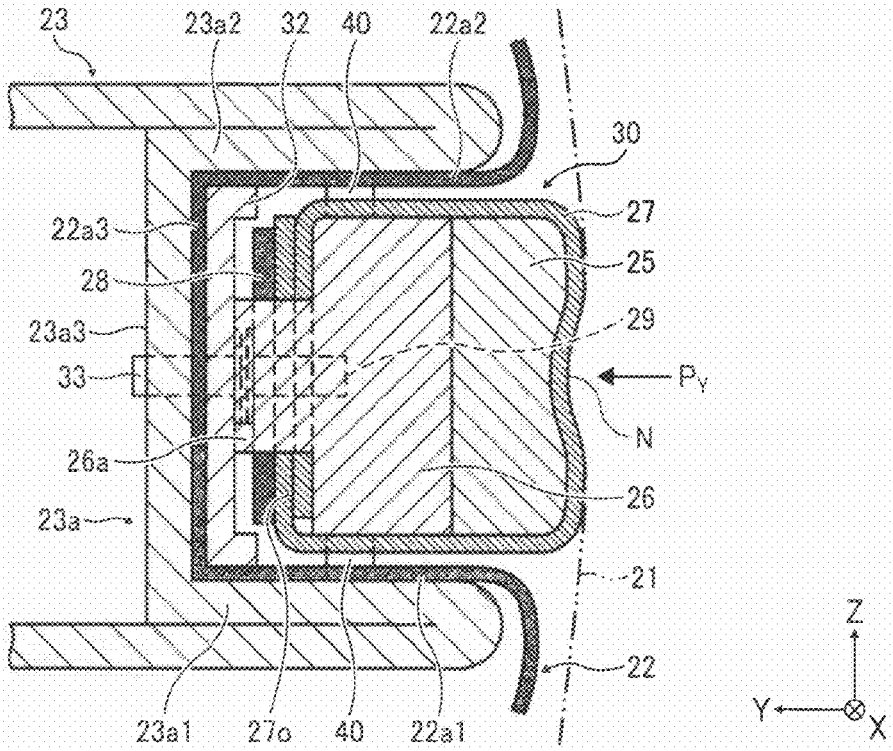
FIG. 6 is an enlarged, end-on view schematically illustrating in greater detail a fuser pad assembly and other components of the fixing device of FIG. 5.

FIG. 6 is an enlarged, end-on view schematically illustrating in greater detail the fuser pad assembly 30 and other components around the fixing nip N of the fixing device 20.

As shown in FIG. 6, the belt holder 22 has the side slot 22*a* defined by a pair of first and second, opposed walls 22*a*1 and 22*a*2 extending parallel to each other substantially in the load direction Y, the former positioned upstream and the latter downstream of the fixing nip N in the sheet conveyance direction Z, as well as a third, central wall 22*a*3 extending between the first and second walls 22*a*1 and 22*a*2 substantially in the sheet conveyance direction Z. The retaining stay 32 and the reinforcing member 23 sandwich the walls of the side slot 22*a* therebetween, and are fixed in place by screws 33 passing through the thicknesses of the retaining stay 32, the belt holder 22, and the reinforcing member 23.

The fuser pad assembly 30 has the fuser pad 25 facing a front side (i.e., toward the pressure roller 31) and the pad base 26 facing a rear side (i.e., away from the pressure roller 31), combined together to form a composite structure around which the lubricant sheet 27 is wrapped with its opposed ends forming an overlap 27*o*. The support plate 28 is held against the overlapping ends 27*o* of the lubricant sheet 27 with screws 29 passing through the support plate 28 and the lubricant sheet 27 to fix them in place onto the pad base 26.

Figure 7:
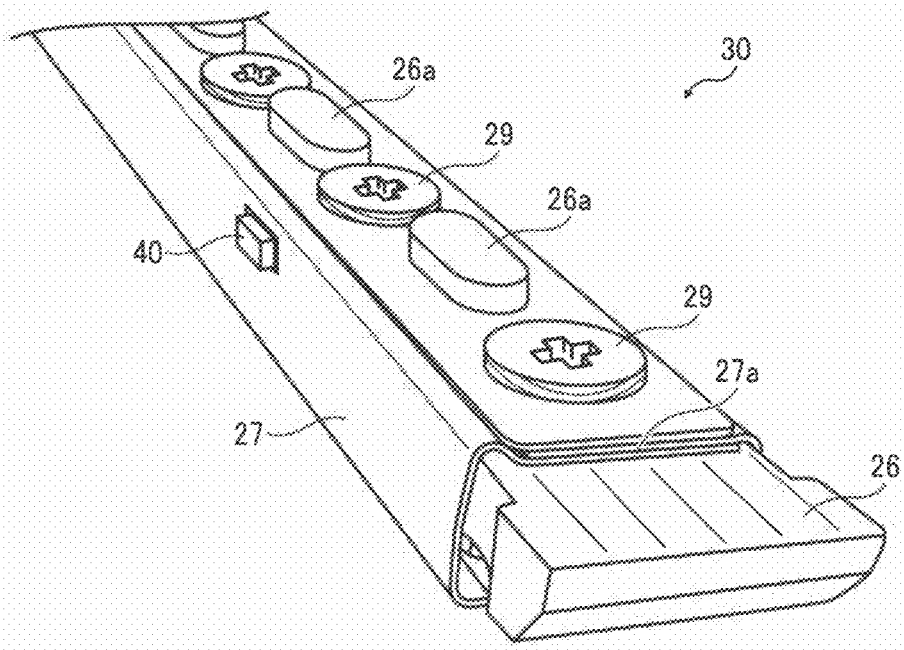
FIG. 7 is a perspective view schematically illustrating the fuser pad assembly of FIG. 6.
Figure 8:
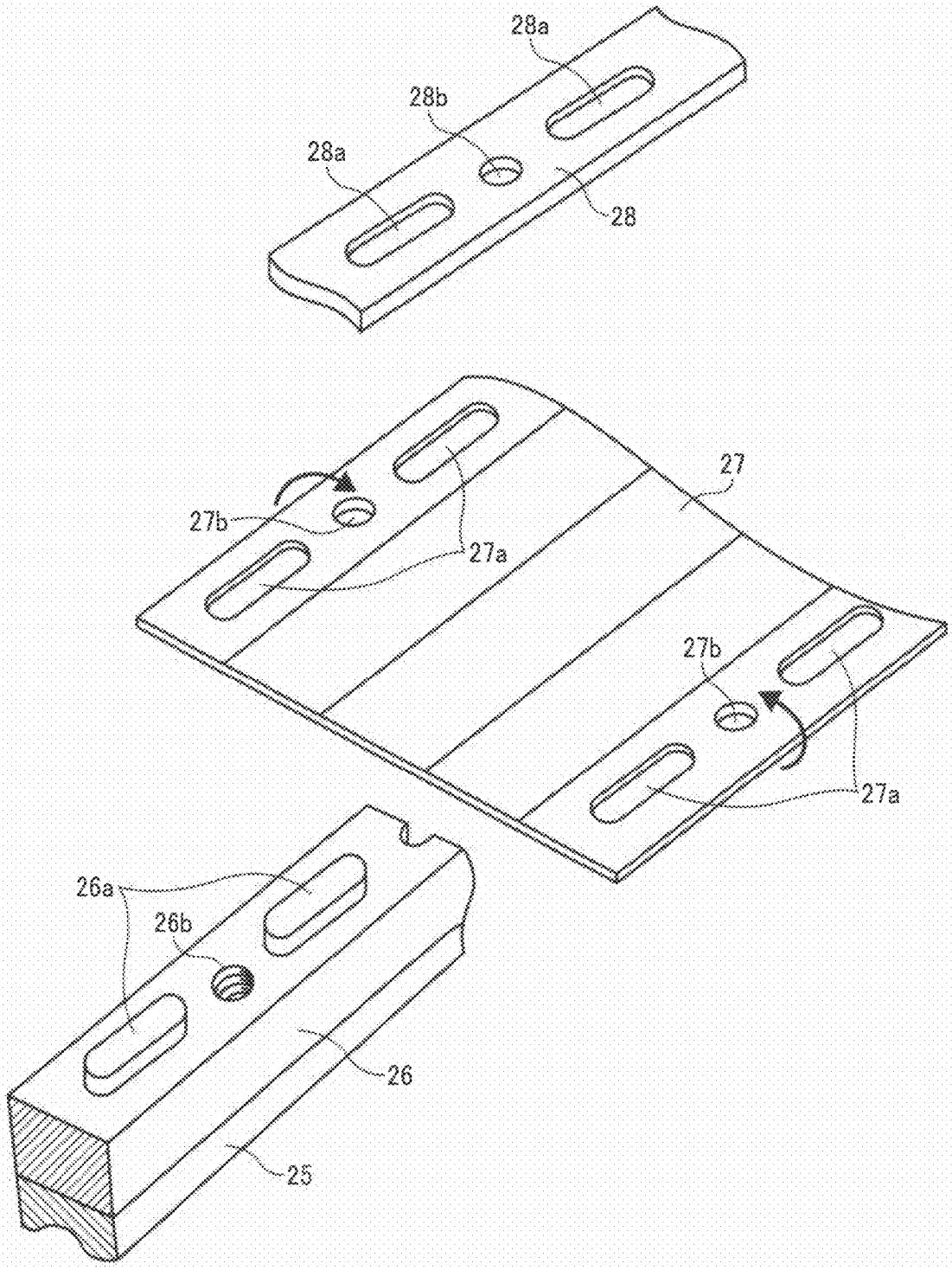
FIG. 8 is an exploded view schematically illustrating the fuser pad assembly of FIG. 6.

With additional reference to FIGS. 7 and 8, which are perspective and exploded views, respectively, schematically illustrating the fuser pad assembly 30 with its front face down and rear face up, there is shown the pad base 26 provided with multiple primary protrusions 26*a* arranged along the longitudinal direction on the rear face, and multiple secondary protrusions 40 on opposite sides adjacent to the rear face, of which only one side is shown in FIG. 7. Between two consecutive protrusions 26*a* of the pad base 26, multiple screw holes 26*b* are defined to receive the screw 29 which connect the pad base 26 together with the fuser pad 25 to the lubricant sheet 27 and the support plate 28, thereby forming the assembled unit 30.

In the fuser pad assembly 30, the fuser pad 25 is formed of an elastic material such as fluorine rubber, and the pad base 26 is formed of a rigid material such as aluminum. The fuser pad 25 has its exposed side curving inward to form a concave surface to which the fuser belt 21 conforms under pressure at the fixing nip N. Alternatively, instead, the fuser pad 25 may have an exposed side formed in a configuration other than a concave surface, such as a flat surface. Nevertheless, forming the fixing nip N along the concave surface is preferable in that it enables a recording sheet S to direct its leading edge toward the pressure roller 31 upon exiting the fixing nip N to prevent adhesion to the fuser belt 21 and concomitant jamming through the fixing nip N.

The lubricant sheet 27 comprises an elongated sheet of material, e.g., non-woven cloth, impregnated with lubricant and foldable along fold lines extending in the longitudinal direction. The lubricant sheet 27 has opposed longitudinal sides thereof each perforated with a series of multiple oval holes or perforations 27*a* for inserting the protrusions 26*a* therethrough, and a series of multiple through-holes 27*b*, each between two consecutive perforations 27*a*, for passing the screws 29 therethrough.

The support plate 28 comprises an elongated piece of metal extending in the longitudinal direction, provided with a series of oval holes or perforations 28*a* for inserting the protrusions 26*a* therethrough, and a series of screw holes 28*b*, each between two consecutive perforations 28*a*, for passing the screws 29 therethrough.

To assemble the fuser pad assembly 30, the lubricant sheet 27 is wrapped around the fuser pad 25 and the pad base 26 stacked or combined together, with its opposed longitudinal ends overlapping to align the two series of perforations 27*a* with each other, into which the protrusions 26*a* of the pad base 26 are passed. Then, the support plate 28 is placed on the overlapping ends 27*o* of the lubricant sheet 27, followed by providing a screw 29 into each screw hole 26*b* through the through-holes 28*b* and 27*b* aligned together.

As shown in FIG. 6, the fuser pad assembly 30 thus completed is installed into the side slot 22*a* of the belt holder 22 with the pad base 26 facing inward and the fuser pad 25 outward, so that the primary protrusions 26*a* on the rear face of the assembly 30 abut against the retaining stay 32 in the load direction Y, and the secondary protrusions 40 on the opposite sides of the assembly 30 abut against the walls 22*a*1 and 22*a*2 of the side slot 22*a* in the sheet conveyance direction Z. Such abutment holds the assembly 30 in place within the side slot 22*a* upon installation of the fixing device 20.

Preferably, the fuser pad assembly 30 may have the series of protrusions 26*a* separated from each other with sufficient intervals therebetween, within which the screws 29 for holding the fuser pad assembly 30 and the screws 33 for mounting the retaining stay 32 and the reinforcing member 23 rest with their screw heads free from contact with the adjoining protrusions 26*a*. Sufficient spacing between the protrusions 26*a* thus allows for provisions of the screws 29 and 33 without interference and concomitant variations in the assembly of the fixing device 20.

Further, although not shown in the drawing, the series of protrusions 26*a* may be dimensioned so that those disposed around a longitudinal center of the base 26 are longer than those disposed at longitudinal ends of the base 26. Should the reinforcing member 23 be bent or deformed under pressure in the load direction Y, this difference in length between the central and terminal protrusions 26*a* compensates for deformation of the reinforcing member. Such arrangement prevents a local reduction in pressure around the longitudinal center of the fuser nip assembly 30, so as to maintain a uniform nip pressure in the axial direction X throughout the fixing nip N.

With further reference to FIG. 6, the reinforcing member 23 is shown provided with a pair of first and second, opposed reinforcing flanges 23*a*1 and 23*a*2 generally extending in the load direction Y along the first and second walls 22*a*1 and 22*a*2, respectively, of the side slot 22*a*. The paired reinforcing flanges 23*a*1 and 23*a*2 are connected together by a web 23*a*3 extending in the sheet conveyance direction Z along the third wall 22*a*3 of the side slot 22*a* to together form a clamping frame 23*a* which clamps together the first and second walls 22*a*1 and 22*a*2 of the belt holder 22 to retain the belt holder 22 in shape.

Figure 9:
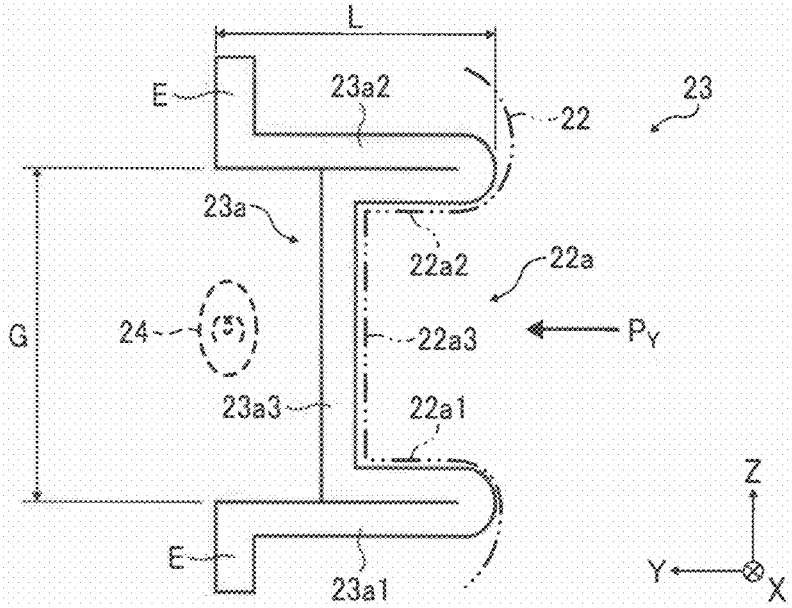
FIG. 9 is an axial cross-sectional view schematically illustrating one embodiment of a reinforcing member included in the fixing device of FIG. 5.

FIG. 9 is an axial cross-sectional view schematically illustrating one embodiment of the reinforcing member 23 with some surrounding structure omitted for brevity.

As shown in FIG. 9, in the present embodiment, the reinforcing member 23 comprises a piece of rigid material, such as stainless steel, obtained through metal bending or hemming, having a generally W-shaped cross-section with a central portion thereof being flattened to form the web 23*a* extending in the sheet conveyance direction Z, and a pair of opposed sides each being bent and folded at least once upon itself to form the pair of first and second flanges 22*a*1 and 22*a*2 extending generally in the load direction Y.

Specifically, for example, the reinforcing member 23 may be formed of a bent sheet of ferrite stainless steel approximately 1.5 mm thick, with its axial cross-section having a length L of approximately 15 mm in the load direction Y and defining a gap G of approximately 14 mm between the first and second flanges 22*a*1 and 22*a*2 in the sheet conveyance direction Z.

In such a configuration, the reinforcing member 23 holds the belt holder 22 and the fuser pad assembly 30 in shape and position by resisting nip pressure applied from the pressure roller 31 in the load direction Y. Moreover, the clamping frame 23*a* of the reinforcing member 23 holding the walls 22*a*1 and 22*a*2 of the side slot 22 effectively prevents deformation due to elastic recovery of a formed material, called "springback", which would occur where the belt holder 21 is formed by bending a thin sheet of material into a rolled configuration with its opposed longitudinal ends spaced apart from each other.

Provision of the reinforcing member 23 hence effectively protects components of the belt holder 21 and the fuser pad assembly 30, in particular, those portions of the belt holder 21 defining the side slot 22*a*, against displacement and deformation during operation. This allows the fuser belt 21 to maintain its generally cylindrical shape around the belt holder 21, and the fuser pad assembly 30 to form the fixing nip N with consistent width and strength during operation.

Compared to a conventional reinforcing beam that has a T-shaped cross-section with a single elongated flange extending in a load direction, the reinforcing member 23 according to this patent specification exhibits higher immunity against deformation, in particular, against bending that occurs in the axial direction under nip pressure. One reason is that the generally W-shaped cross-section, which is partially double-walled, and therefore stiffened, effectively resists external force against the first and second reinforcing flanges 22*a*1 and 22*a*2. Another reason is that the generally W-shaped cross-section provides a relatively high second moment of area compared to that of a simple T-shaped cross-section.

Specifically, the strength and immunity against bending of the reinforcing member 23 under load depends on a cross-sectional area taken in the axial direction X, and in particular, on the transaxial length L extending in the load direction Y which determines a second moment of area of the reinforcing member 23. That is, the greater the axial cross-section and the transaxial dimension L, the less likely the reinforcing member 23 is to bend in the axial direction X under nip pressure. Compared to a simple T-beam reinforcement, the reinforcing member 23 with the pair of opposed flanges 23*a*1 and 23*a*2 can withstand higher pressures for a given length L in the load direction Y.

In addition to immunity against bending, the reinforcing member 23 according to this patent specification is advantaged over a conventional T-beam reinforcement in terms of thermal efficiency in heating the belt holder 22 by radiation with the heater 24. This is because provision of the paired flanges 23*a*1 and 23*a*2 only requires a relatively small dimension L of the reinforcing member 23 in the load direction Y, which does not excessively intercept radiation from the heater 24, allowing for more heat to reach the circumference of the belt holder 22 than is possible with a single-flanged T-beam configuration.

Moreover, positioning the paired flanges 22*a*1 and 22*a*2 on the opposed sides of the fixing nip N allows for positioning the radiant heater 24 opposite where the belt holder 22 forms the side slot 22*a*. Such arrangement maximizes the thermal efficiency of the heater 24, while ensuring a proper length of the reinforcing member 23 in the load direction Y for obtaining sufficient strength.

With continued reference to FIG. 9, in the present embodiment, the reinforcing member 23 has each of the paired flanges 23*a*1 and 23*a*2 terminating in a distal end E pointing away from the central web 23*a* substantially at a right angle to the load direction Y. Provision of the angled edges E of the paired flange 23*a*1 and 23*a*2 allows for designing the reinforcing member 23 with a relatively large axial cross-section, which, together with the relatively large transaxial length L, leads to increased strength and high immunity against bending of the reinforcing member 23 under nip pressure.

Figure 10:
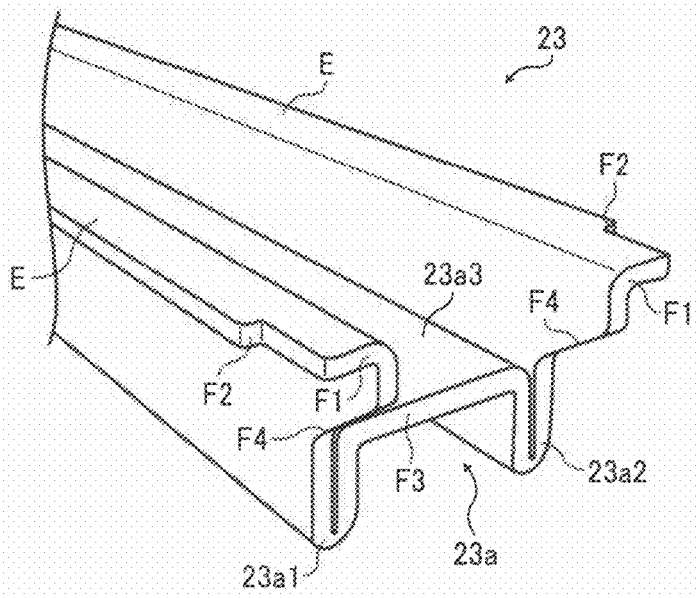
FIG. 10 is a perspective view schematically illustrating one longitudinal end of the reinforcing member of FIG. 9.
Figure 11:
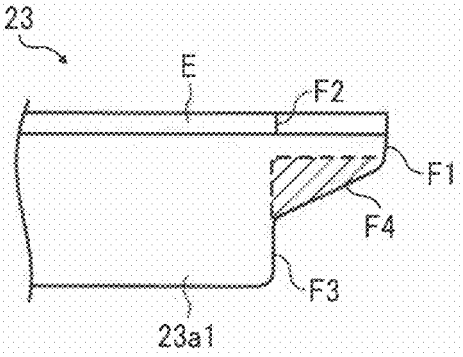
FIG. 11 is a side view schematically illustrating one longitudinal end of the reinforcing member of FIG. 9.

FIGS. 10 and 11 are perspective and side views, respectively, schematically illustrating one longitudinal end of the reinforcing member 23.

As shown in FIGS. 10 and 11, at the longitudinal end of the reinforcing member 23 are a pair of raised, first faces F1 defined by the angled ends E of the first and second flanges 23*a*1 and 23*a*2; a pair of recessed, second faces F2 formed by cutting edges of the angled ends E; a recessed, third face F3 defined by the central portion of the reinforcing member 23 substantially coplanar with the second faces F2; and a pair of sloped, fourth faces F4 each connecting the first face F1 to the third face F3.

Figure 12:
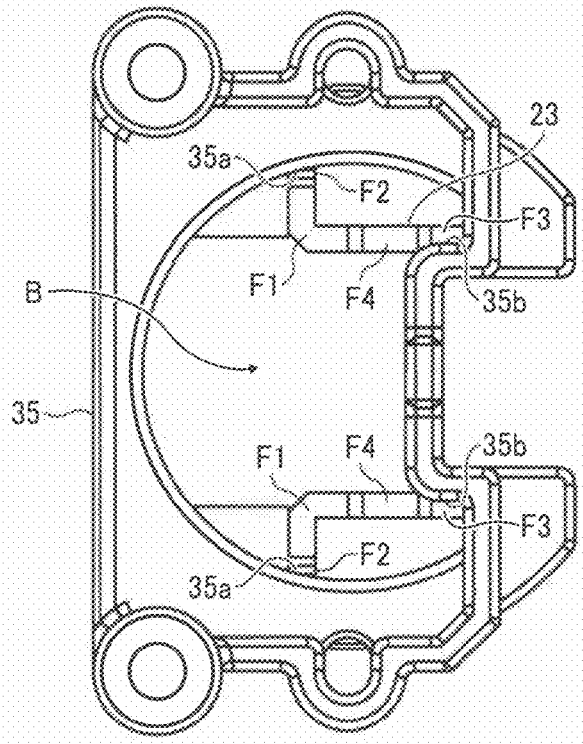
FIG. 12 is an end-on, axial cutaway view schematically illustrating the longitudinal end of the reinforcing member of FIG. 9 provided with a mounting flange.
Figure 13:
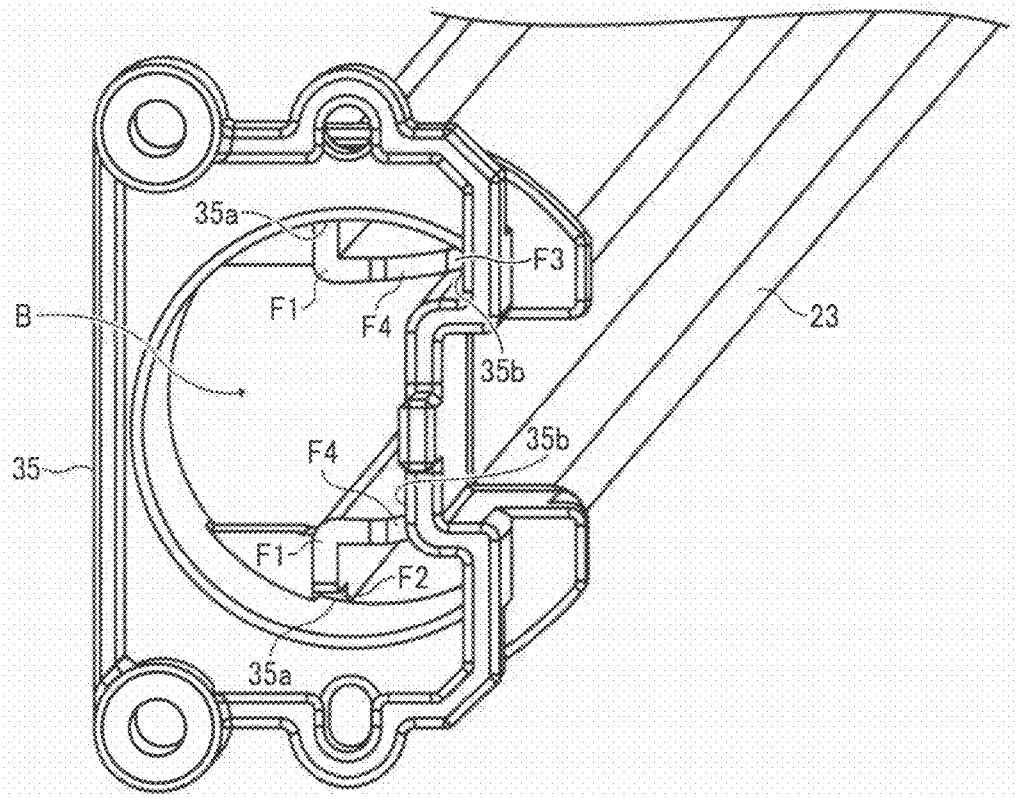
FIG. 13 is a perspective view of the flanged end of the reinforcing member of FIG. 9 taken from one side of the mounting flange.
Figure 14:
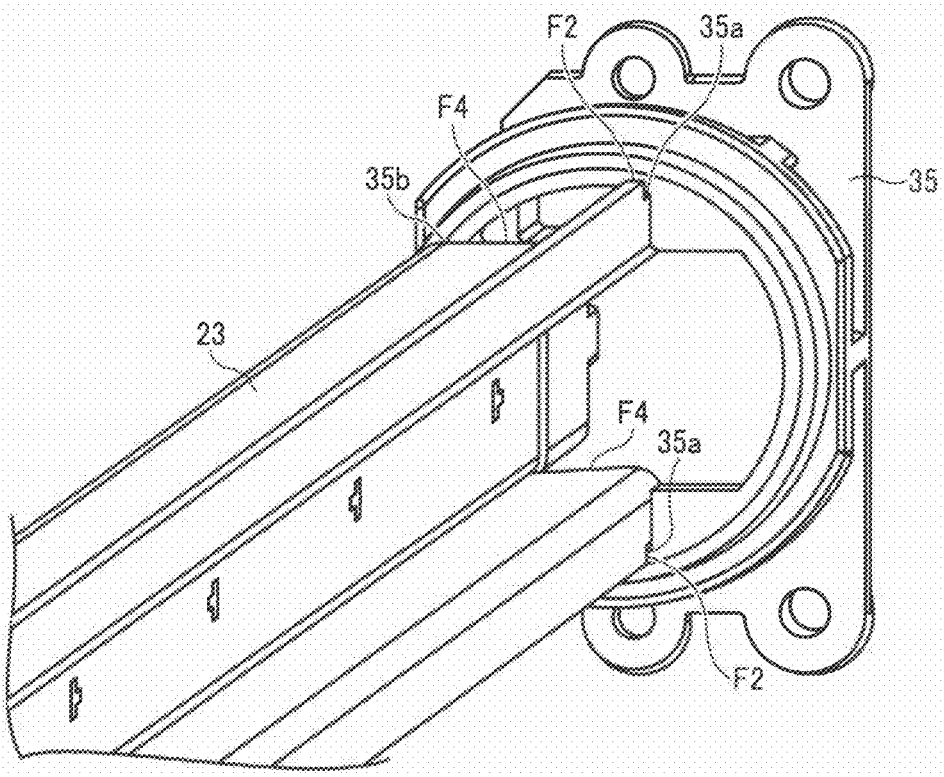
FIG. 14 is a perspective view of the flanged end of the reinforcing member of FIG. 9 taken from another side of the mounting flange.

FIG. 12 is an end-on, axial cutaway view schematically illustrating the longitudinal end of the reinforcing member 23 connected to the mounting flange 35 to be installed on the chassis of the fixing device 20, and FIGS. 13 and 14 are perspective views of the flanged end of the reinforcing member 23 taken from opposite sides of the mounting flange 35.

As shown in FIGS. 12 through 14, the mounting flange 35 comprises a generally annular member having a bore hole or opening B defining multiple contact portions 35*a* and 35*b* along its circumference to receive the longitudinal end of the reinforcing member 23. The reinforce member 23 has its longitudinal end held on the annular mounting flange 35 by engaging the recessed faces F2 and F3 with the first and second contact portions 35*a* and 35*b*, respectively, along the edge of the bore hole B within which the raised and sloped faces F1 and F4 are accommodated.

Note that the width of the reinforcing member 23 inserted into the bore hole B of the mounting flange 35 (i.e., the distance between the distal ends of the first faces F1) is smaller than the overall width of the reinforcing member 23 (i.e., the distance between the distal ends of the second faces F2). Providing the reinforcing member 23 with the narrower longitudinal end allows for designing the annular mounting flange 35 with a smaller bore hole B, which reduces the overall size of the fixing device 20 where the size of the mounting flange 35 determines or otherwise influences the diameters of the belt holder 22 and the looped fuser belt 21 connected thereto.

Moreover, cutting away the edges of the reinforcing member 23 enables narrowing the longitudinal end without substantially affecting the strength of the reinforcing member 23. That is, compared to a configuration where the entire length of the reinforcing member has a relatively narrow, uniform width equal to the distance between the distal edges of the first faces F1, the reinforcing member 23 with the narrowed longitudinal end exhibits sufficient strength to resist nip pressure while allowing for a more compact mounting flange 35 and its associated structure.

With specific reference to FIG. 11, there is shown the fourth face F4 connecting the first face F1 to the third face F3 at a slanting angle. Compared to connecting the raised and recessed faces F1 and F3 by horizontal and perpendicular surfaces, forming the sloped connecting surface F4 yields a greater area or volume of the reinforcing flange (indicated by a shaded portion in the drawing) that contributes to strength and immunity against deformation of the reinforcing member 23.

Hence, according to this patent specification, the fixing device 20 according to this patent specification provides high-speed, on-demand fixing performance with high mechanical stability and excellent thermal properties through use of the thermal belt holder 22 for heating the fuser belt 21, owing to the mechanically stable, thermally efficient reinforcing member 23 which can be installed using the mounting flanges 35, without significantly compromising mechanical stability and thermal efficiency.

Preferably, the reinforcing member 23 is formed of a single piece of material, e.g., a bent sheet of metal as in the case of the embodiment described primarily with reference to FIG. 9. Consider a configuration where the reinforcing member is formed of multiple pieces of material screwed or welded together to form a composite structure. Upon installation, such composite reinforcing member has its components subjected to heating with varying temperatures depending on the location relative to the heat source to develop varying degrees of thermal expansion (i.e., the closer to the heat source, the more the thermal expansion), resulting in bending or deformation in the axial direction X to cause inconsistent length or pressure of the fixing nip. By contrast, a monolithic reinforcing member 23, formed of a single continuous piece, can maintain a uniform strength of the fixing nip N upon heating during operation.

Although in the several embodiments described above, the reinforcing member 23 is configured as a worked piece of metal with a generally W-shaped cross-section, obtained through bending or hemming to form a clamping frame 23*a* defined by a pair of double-walled flanges 23*a*1 and 23*a*2 each with a distal end E pointing substantially at a right angle to the load direction Y, the configuration of the reinforcing member 23 is not limited to those described hereinabove.

For example, in a further embodiment, the reinforcing member 23 may be formed by bending a sheet of material more than once in on itself to obtain a clamping frame 23*a* with a pair of triple- or more multi-walled flanges 23*a*1 and 23*a*2 for greater strength.

Figure 15:
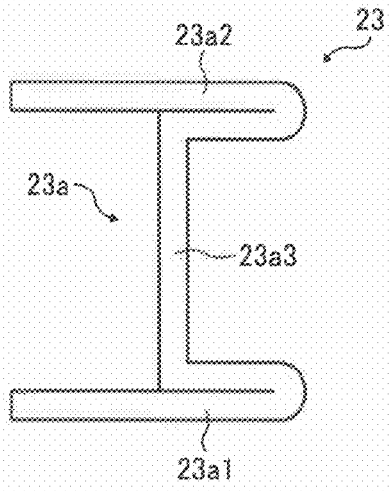
FIG. 15 is a cross-sectional view schematically illustrating a further embodiment of the reinforcing member included in the fixing device of FIG. 5.

In a still further embodiment, either or both of the reinforcing flanges 23*a*1 and 23*a*2 may have the distal ends E pointing at an angle other than 90 degrees to the load direction Y. FIG. 15 is a cross-sectional view schematically illustrating such embodiment of the reinforcing member 23, in which the paired reinforcing flanges 23*a*1 and 23*a*2 have their distal ends E pointing straight toward the load direction Y.

Figure 16:
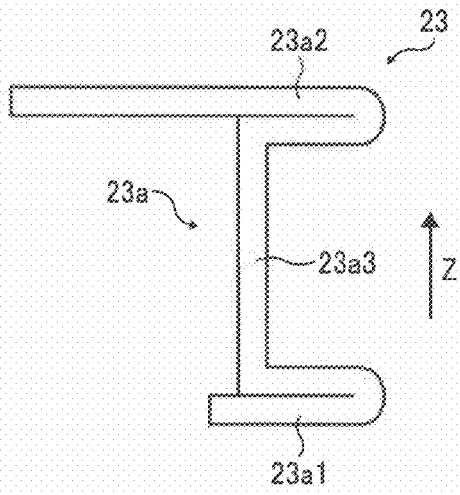
FIG. 16 is a cross-sectional view schematically illustrating a still further embodiment of the reinforcing member included in the fixing device of FIG. 5.

In still another and further embodiment, the reinforcing flanges 23*a*1 and 23*a*2 may be asymmetrically formed, that is, may be of unequal lengths in the load direction Y. FIG. 16 is a cross-sectional view schematically illustrating such embodiment of the reinforcing member 23, in which the first reinforcing flange 23*a*1 is shorter than the second reinforcing flange 23*a*2. Such shortening of the reinforcing flange 23*a*1 reduces an amount of radiation intercepted by the reinforcing member 23, which increases the amount of heat used to heat the belt holder 22 leading to high thermal efficiency in heating the fuser belt 21 with the belt holder 22.

Note that, in this embodiment, the shorter flange 23*a*1 is located upstream of the fixing nip N, whereas the longer flange 23*a*2 is located downstream of the fixing nip N, so that the reinforcing member 23 exhibits higher strength and immunity against bending downstream than upstream of the fixing nip N in the sheet conveyance direction Z. Since deformation of the fuser assembly occurring downstream of the fixing nip N affects imaging quality and sheet conveyance more than that occurring upstream of the fixing nip N, such an arrangement provides high thermal efficiency without unduly sacrificing performance of the fixing device 20 using the reinforcing member 23.

Figure 17:
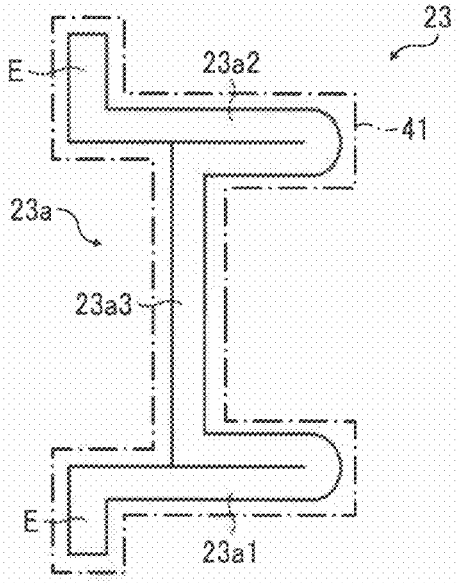
FIG. 17 is a cross-sectional view schematically illustrating a still further embodiment of the reinforcing member included in the fixing device of FIG. 5.

In yet still another and further embodiment, the reinforcing member 23 may be coated with a material that is less thermally absorptive than the material of the reinforcing member 23 itself. FIG. 17 is a cross-sectional view schematically illustrating such embodiment of the reinforcing member 23, in which the reinforcing member 23 formed of stainless steel is provided with a vapor-deposited coating 41 of lower emissivity and absorption, such as aluminum or silver.

The outer coating 41 prevents the reinforcing member 23 from absorbing excessive heat from radiation, upon installation inside the belt holder 22 adjacent to the heater 24. Preventing heat absorption by the reinforcing member 23 in turn promotes heat absorption by the belt holder 22, resulting in a high thermal efficiency in heating the fuser belt 21 by the conductive belt holder 22.

The reinforcing member 23 provided with the coating 41 is preferable in terms of mechanical stability compared to forming the entire body of the reinforcing member of a material of low emissivity and absorption, which can develop significant deformation under nip pressure. Provision of the coating 41 thus provides high thermal efficiency without sacrificing strength of the reinforcing member 23.

Figure 18:
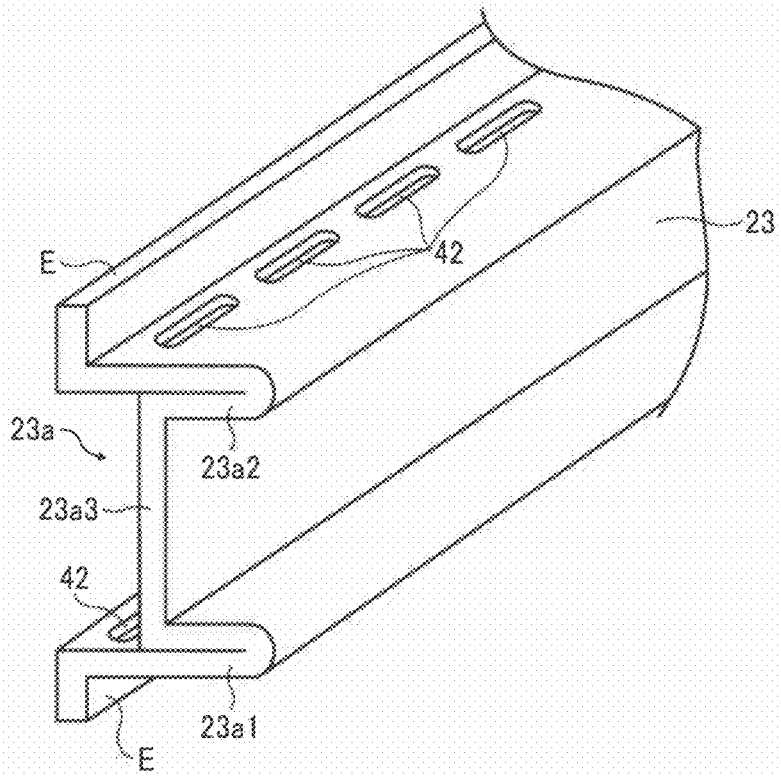
FIG. 18 is a perspective view schematically illustrating a still further embodiment of the reinforcing member included in the fixing device of FIG. 5.

In yet still another, different, and further embodiment, the reinforcing member 23 may be perforated along the axial direction X to allow passage of radiation therethrough. FIG. 18 is a perspective view schematically illustrating such embodiment of the reinforcing member 23, in which the reinforcing flanges 23*a*1 and 23*a*2 are perforated with multiple perforations or openings 42 arranged in the axial direction X and apart from the double-walled portions defining the clamping frame 23*a*.

Figure 19:
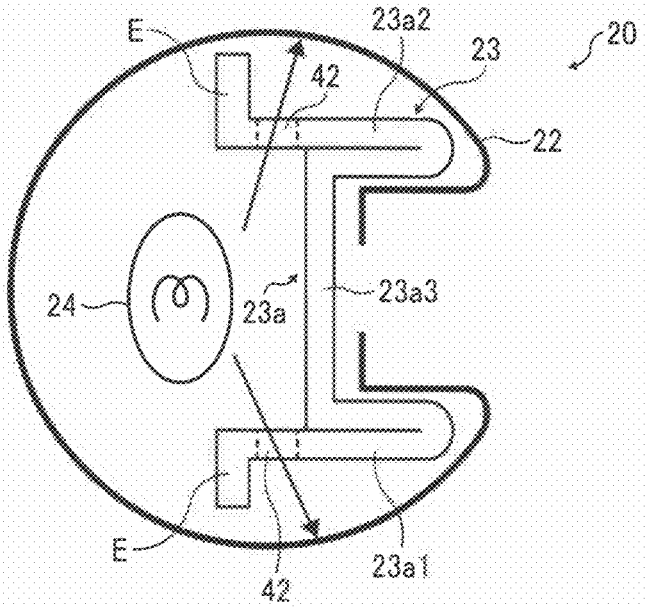
FIG. 19 is an end-on, axial cutaway view of the reinforcing member of FIG. 18 installed in the fixing device.

During operation, the openings 42 allow radiation from the heater 24 to pass through the reinforcing member 23 to reach the circumference of the belt holder 22, as shown in FIG. 19. Moreover, forming the perforations 42 reduces heat capacity of the reinforcing member 23, which absorbs certain amounts of heat when irradiated inside the tubular belt holder 22, resulting in a reduced amount of heat lost by absorption in heating the belt holder 22. Providing passage of radiation and reduced heat capacity of the reinforcing member 23 thus enables the belt holder 22 to absorb greater amounts of heat for subsequent transfer to the fuser belt 21, resulting in increased thermal efficiency of the fixing device 20 using the reinforcing member 23.

Preferably, the multiple openings 42 provided on the reinforcing flange have a uniform shape, and are evenly spaced apart from each other in the axial direction X. More preferably, the reinforcing member 23 is perforated along a length greater than a maximum compatible width of recording sheet that the fixing device 20 can accommodate in the fixing nip N. Such arrangement serves to equalize the rate at which the belt holder 22 absorbs heat for heating the belt 21 within the fixing nip N, thereby allowing for obtaining high thermal efficiency with the perforations 42 without causing significant variations in processing temperature at the fixing nip N.

Although the embodiments described above describe the fixing device employing a pressure roller, the reinforcing member according to this patent specification may be used with any suitable type of pressure members, such as belt or pad, pressed against a fuser pad to form a fixing nip. Furthermore, although the embodiments described above describe the fixing device employing a multi-layered fuser belt formed of a substrate combined with elastic and releasing layers, the reinforcing member according to this patent specification may be used with any suitable type of endless belt or film, formed of any one or combination of polyimide, polyamide, fluorine resin, and metal, looped for rotation around the belt holder. In any such configuration, the fixing device provides reliable, high-speed imaging performance with consistent width and strength of the fixing nip owing to the reinforcing member highly immune to deformation under nip pressure.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

an endless belt looped into a generally cylindrical configuration extending in an axial direction thereof;

a fuser pad extending in the axial direction inside the loop of endless belt;

a pressure member extending in the axial direction with the belt interposed between the fuser pad and the pressure member, the pressure member being pressed against the fuser pad through the endless belt to form a fixing nip through which a recording medium travels from upstream to downstream in a tangential direction substantially perpendicular to the axial direction;

a generally cylindrical, tubular belt holder extending in the axial direction inside the loop of endless belt to retain the belt in shape along an outer circumference thereof, the belt holder accommodating the fuser pad in a longitudinal side slot defined on one side thereof by a pair of opposed first and second walls extending inward from the holder circumference, the former being upstream and the latter downstream of the fixing nip in the tangential direction; and a reinforcing member disposed inside the belt holder to reinforce the belt holder around the side slot, the reinforcing member including:

a first flange extending along the first wall inside the belt holder; and a second flange extending along the second wall inside the belt holder, wherein the reinforcing member comprises a bent sheet of material that has a pair of opposed sides each bent and folded at least once in upon itself to form the pair of first and second flanges.

2. The fixing device according to claim 1, wherein the first and second flanges extend in a load direction substantially perpendicular to the axial and tangential directions in which the pressure member is pressed against the fuser pad.

3. The fixing device according to claim 1, wherein an edge of at least one of the first and second flanges is angled with respect to a direction in which it extends along the wall of the belt holder.

4. A fixing device comprising:

an endless belt looped into a generally cylindrical configuration extending in an axial direction thereof;

a fuser pad extending in the axial direction inside the loop of endless belt;

a pressure member extending in the axial direction with the belt interposed between the fuser pad and the pressure member, the pressure member being pressed against the fuser pad through the endless belt to form a fixing nip through which a recording medium travels from upstream to downstream in a tangential direction substantially perpendicular to the axial direction;

a generally cylindrical, tubular belt holder extending in the axial direction inside the loop of endless belt to retain the belt in shape along an outer circumference thereof, the belt holder accommodating the fuser pad in a longitudinal side slot defined on one side thereof by a pair of opposed first and second walls extending inward from the holder circumference, the former being upstream and the latter downstream of the fixing nip in the tangential direction; and a reinforcing member disposed inside the belt holder to reinforce the belt holder around the side slot, the reinforcing member including:

a first flange extending along the first wall inside the belt holder; and a second flange extending along the second wall inside the belt holder, wherein the second flange is longer than the first flange.

5. The fixing device according to claim 1, wherein the reinforcing member retains the belt holder in a generally cylindrical, tubular shape with the first and second flanges.

6. The fixing device according to claim 1, wherein the reinforcing member has the first and second flanges connected together to form a clamping frame that clamps together the first and second walls of the belt holder to retain the belt holder in a generally cylindrical, tubular shape.

7. The fixing device according to claim 1, further comprising:

a radiant heater disposed inside the belt holder to irradiate the belt holder to heat the belt opposite where the belt holder forms the side slot equipped with the reinforcing member.

8. The fixing device according to claim 7, wherein the reinforcing member is perforated with one or more openings along the axial direction thereof to allow passage of radiation from the radiant heater.

9. The fixing device according to claim 8, wherein the reinforcing member is perforated along a length greater than a maximum compatible width of recording sheet that the fixing device can accommodate in the fixing nip.

10. The fixing device according to claim 1, wherein the reinforcing member is coated with a material that is less thermally absorptive than a material of the reinforcing member.

11. The fixing device according to claim 1, wherein the reinforcing member comprises a steel body provided with a coating of aluminum.

12. The fixing device according to claim 1, wherein the reinforcing member comprises a steel body provided with a coating of silver.

13. An image forming apparatus comprising:

an electrophotographic imaging unit to form a toner image on a recording medium; and a fixing device to fix the toner image in place on the recording medium, the fixing device including:

an endless belt looped into a generally cylindrical configuration extending in an axial direction thereof;

a fuser pad extending in the axial direction inside the loop of endless belt;

a pressure member extending in the axial direction with the belt interposed between the fuser pad and the pressure member, the pressure member being pressed against the fuser pad through the endless belt to form a fixing nip through which the recording medium travels from upstream to downstream in a tangential direction substantially perpendicular to the axial direction;

a generally cylindrical, tubular belt holder extending in the axial direction inside the loop of endless belt to retain the belt in shape along an outer circumference thereof, the belt holder accommodating the fuser pad in a longitudinal side slot defined on one side thereof by a pair of opposed first and second walls extending inward from the holder circumference, the former being upstream and the latter downstream of the fixing nip in the tangential direction; and a reinforcing member disposed inside the belt holder to reinforce the belt holder around the side slot, the reinforcing member including:

a first flange extending along the first wall inside the belt holder; and a second flange extending along the second wall inside the belt holder, wherein the reinforcing member comprises a bent sheet of material that has a pair of opposed sides each bent and folded at least once in upon itself to form the pair of first and second flanges.

* * * * *